US007390180B2

(12) United States Patent
Lee et al.

(10) Patent No.: US 7,390,180 B2
(45) Date of Patent: Jun. 24, 2008

(54) OIL PUMPING DEVICE OF HERMETIC COMPRESSOR

(75) Inventors: Dong-Soo Lee, Seoul (KR); Chul-Su Jung, Seoul (KR); Jeong-Hwan Suh, Seoul (KR); Seung-Yup Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/527,472

(22) Filed: Sep. 27, 2006

(65) Prior Publication Data

US 2007/0071627 A1 Mar. 29, 2007

(30) Foreign Application Priority Data

Sep. 28, 2005 (KR) ..... 10-2005-0090826

(51) Int. Cl.
*F03C 2/00* (2006.01)
*F04C 2/00* (2006.01)

(52) U.S. Cl. ..... 418/88; 418/15; 418/55.1; 418/55.6; 418/92; 418/94; 418/171; 184/6.18

(58) Field of Classification Search ..... 418/15, 418/55.1–55.6, 57, 88, 92, 94, 98, 166, 171; 184/6.12, 6.16, 6.18
See application file for complete search history.

(56) References Cited

U.S. PATENT DOCUMENTS

| | | | | | |
|---|---|---|---|---|---|
| 3,242,867 | A | * | 3/1966 | Mosbacher | 418/15 |
| 4,898,521 | A | * | 2/1990 | Sakurai et al. | 418/171 |
| 5,660,531 | A | * | 8/1997 | Merkle et al. | 418/15 |
| 2007/0122303 | A1 | * | 5/2007 | Kim et al. | 418/55.6 |

FOREIGN PATENT DOCUMENTS

| | | | |
|---|---|---|---|
| JP | 06147177 | A * | 5/1994 |
| JP | 07103170 | A * | 4/1995 |
| JP | 09-170579 | | 6/1997 |
| JP | 10220377 | A * | 8/1998 |

* cited by examiner

*Primary Examiner*—Theresa Trieu
(74) *Attorney, Agent, or Firm*—Ked & Associates, LLP

(57) ABSTRACT

A hermetic compressor uses an oil pump that includes a trochoid gear. Therefore, regardless of the rotation speed of a driving motor of the compressor, a sufficient amount of oil can always be pumped. The oil pump unit may include a plurality of suction holes with openings at different heights. If the refrigerant and oil separate, at least one of the openings will admit oil into the oil pump unit, to ensure lubricating oil is supplied to the moving parts of the compressor.

24 Claims, 8 Drawing Sheets

OIL PUMPING DEVICE OF HERMETIC COMPRESSOR

This application claims priority under 35 U.S.C. §119 to Korean Patent Application No. 2005-0090826, filed in Korea on Sep. 28, 2005, the entirety of which is hereby incorporated by reference.

BACKGROUND OF THE INVENTION

1. Field of the Invention

The present invention relates to an oil pump of a hermetic compressor, and more particularly, to an oil pumping device of a hermetic compressor using a trochoid pump so as to pump oil by using a variation in volume.

2. Description of the Background Art

In, general, a hermetic compressor includes a compression part and a motor part inside a hermetic casing. When the compression part operates by a driving force of a motor part, the compressor part sucks, compresses, and discharges refrigerant. Recently, in order to minimize environmental pollution, such as global warming, the use of CFC-based refrigerant has been gradually regulated in the hermetic compressor field. Therefore, in order to minimize the environment pollution and improve efficiency of the compressor, alternative refrigerants have been used. Also, research on different oils suitable for the alternative refrigerants has been performed.

The type of oil influences the performance of sliding parts. When oil is easily separated from the refrigerant, the refrigerant, having a higher density, flows downward due to gravity. If the oil pump of such a compressor pulls oil from the bottom of the compressor casing, this can result in the sliding parts being supplied with more refrigerant than oil. As a result, abrasion of the sliding parts may be increased due to lack of oil.

FIG. 1 is a longitudinal sectional diagram illustrating one embodiment of a scroll compressor using a centrifugal oil pump according to the related art. As shown therein, the related art scroll compressor includes a casing 1 filled with a predetermined amount of oil, a main frame 2 and a sub-frame 3 that are fixed to upper and lower sides, respectively, inside the casing 1/A driving shaft 4 is coupled with a rotor of a driving motor (M) mounted between the main frame 2 and the sub-frame 3 so as to transmit a rotary force. An orbiting scroll 5 is eccentrically coupled with the driving shaft 4 of the driving motor (M) and performs an orbiting motion at an upper surface of the main frame 2. A fixed scroll 6 is fixed to the main frame 2 so as to be engaged with the orbiting scroll 5 so as to form a plurality of compression chambers (P) with the orbiting scroll 5. An Oldham's ring 7 is installed between the orbiting scroll 5 and the main frame 2 so as to prevent rotation of the orbiting scroll 5 and allow the orbiting scroll to perform an orbiting motion. A check valve 8 is coupled to a rear surface of an end plate portion of the fixed scroll 6 so as to prevent backflow of compression gas. A centrifugal oil pump 9 is installed under the driving shaft 4 and acts to pump oil within the casing 1 by a centrifugal force generated by rotation of the driving shaft 4.

An internal space of the casing 1 is divided into a suction area (S1) which is a low pressure part, and a discharge area (S2) which is a high pressure part by a high and low pressure separation plate 1*a* that is fixed to an upper surface of the fixed scroll 6. A gas suction pipe (SP) is connected to the suction area (S1), while a gas discharge pipe (DP) is connected to the discharge area (S2).

The driving shaft 4 includes a shaft portion 4*a* coupled with the rotor (Mr), a driving pin portion 4*b* eccentrically protruding from an upper end of the shaft portion 4*a* and coupled to the orbiting scroll 5, and an oil path 4*c* penetrating the driving shaft 4 from a lower end of the shaft portion 4*a* to an upper end of the driving pin portion 4*b* so as to guide oil which is pumped by the oil pump 9. 5*a* and 6*a* denote a wrap of the orbiting scroll and a wrap of the fixed scroll, respectively. Also, Ms denotes a stator of the motor M.

The oil pump 9 is fixed to a lower end of the oil path 4*c*. The oil pump 9 is a centrifugal oil pump, which includes a propeller. The oil pump 9 rotates together with the driving shaft 4, when the driving shaft 4 rotates, so as to pump the oil in the casing 1 by the centrifugal force.

When power is applied to the driving motor (M) and the driving shaft 4 rotates, the orbiting scroll 5 at the upper surface of the main frame 2 orbits, to thereby form a pair of compression chambers (P), which continuously move toward the center, between the wrap 5*a* of the orbiting scroll 5 and the wrap 6*a* of the fixed scroll 6. The compression chambers (P) move toward the center by the continuous orbiting movement of the orbiting scroll 5 so as to reduce a volume thereof. Here, after refrigerant gas is sucked and compressed, the compressed gas is discharged into the casing 1.

At this time, oil is pumped by the centrifugal force of the centrifugal oil pump 9 when the driving shaft 4 rotates at a high speed, and the pumped oil is forced up though the oil path 4*c*. Some oil lubricates between the main frame 2 and the driving shaft 4, and other oil is scattered from the upper end of the driving shaft 4 so as to lubricate between the main frame 2 and the orbiting scroll 5.

Because the oil pump 9 is a centrifugal oil pump that pumps oil using centrifugal force, it is possible for the oil pump 9 to smoothly pump the oil during high-speed operations. However, during low-speed operations, the centrifugal force decreases, and it may be impossible for the oil pump 9 to smoothly pump the oil. Therefore, during low speed operations, abrasion between components is caused by lack of oil in the sliding parts, and reliability and performance of the compressor may be reduced.

In addition, when the refrigerant and oil are completely mixed with each other, the oil can smoothly be pumped regardless of how deeply the oil pump 9 sinks under the oil. However, a 'double-layer separation phenomenon' may occur. That is, the refrigerant and the oil separate form each other due to density differences. The refrigerant, having relatively high density, is deposited at the bottom of the two layers. Therefore, the oil pump 9 mostly pumps the refrigerant and fails to pump the oil. This increases abrasion caused by lack of oil in each of the sliding parts. Therefore, reliability and performance of the compressor are seriously reduced.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The present invention provides an oil pumping device of a hermetic compressor that is capable of pumping oil to ensure moving parts of the compressor are lubricated, regardless of operation speeds of the compressor. An oil pumping device embodying the invention is capable of preventing reduction of reliability which is caused by dry friction of the compressor by smoothly pumping oil, even when the oil becomes separated from the refrigerant, and even when operational speeds are low.

An oil pumping device of a hermetic compressor embodying the invention includes a casing filled with a predetermined amount of oil, and having therein a motor part that generates a driving force and a compression part that is coupled with a driving shaft of the motor part and compresses refrigerant. A frame fixed to the inside of the casing supports the driving shaft of the motor part. An oil pumping unit has a trochoid gear that is coupled with the driving shaft of the motor part and that pumps oil while the trochoid gear performs a relative rotary motion so as to vary a volume thereof.

In some embodiments of the invention, the oil pumping unit has a plurality of suction holes that extend in a direction perpendicular to the surface by a predetermined height difference such that the oil can always be pumped, even when the oil and the refrigerant separate.

Figure 1:
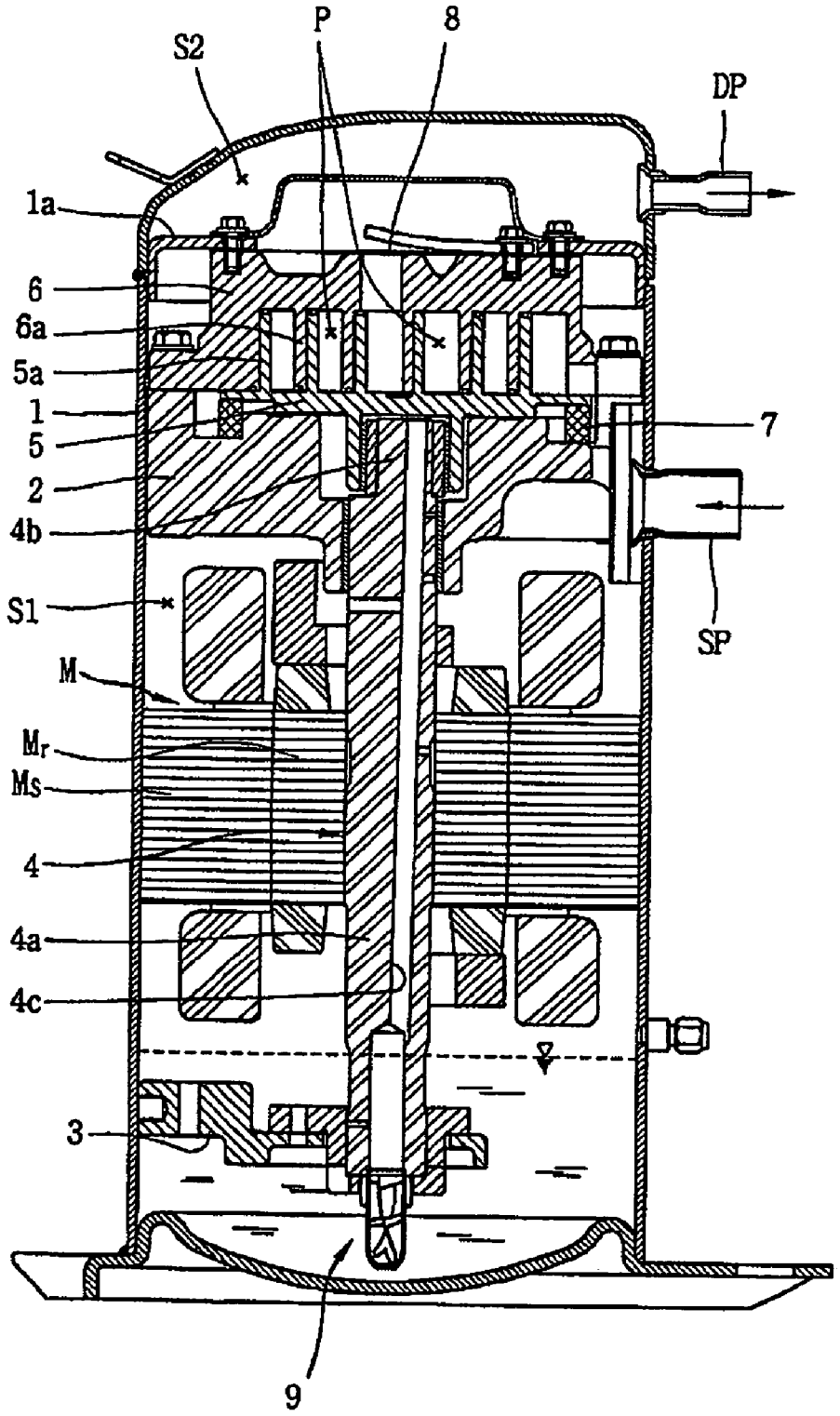
FIG. 1 CONVENTIONAL ART
FIG. 1 is a cross-longitudinal sectional diagram illustrating a scroll compressor using a centrifugal pump according to the related art.
Figure 2:
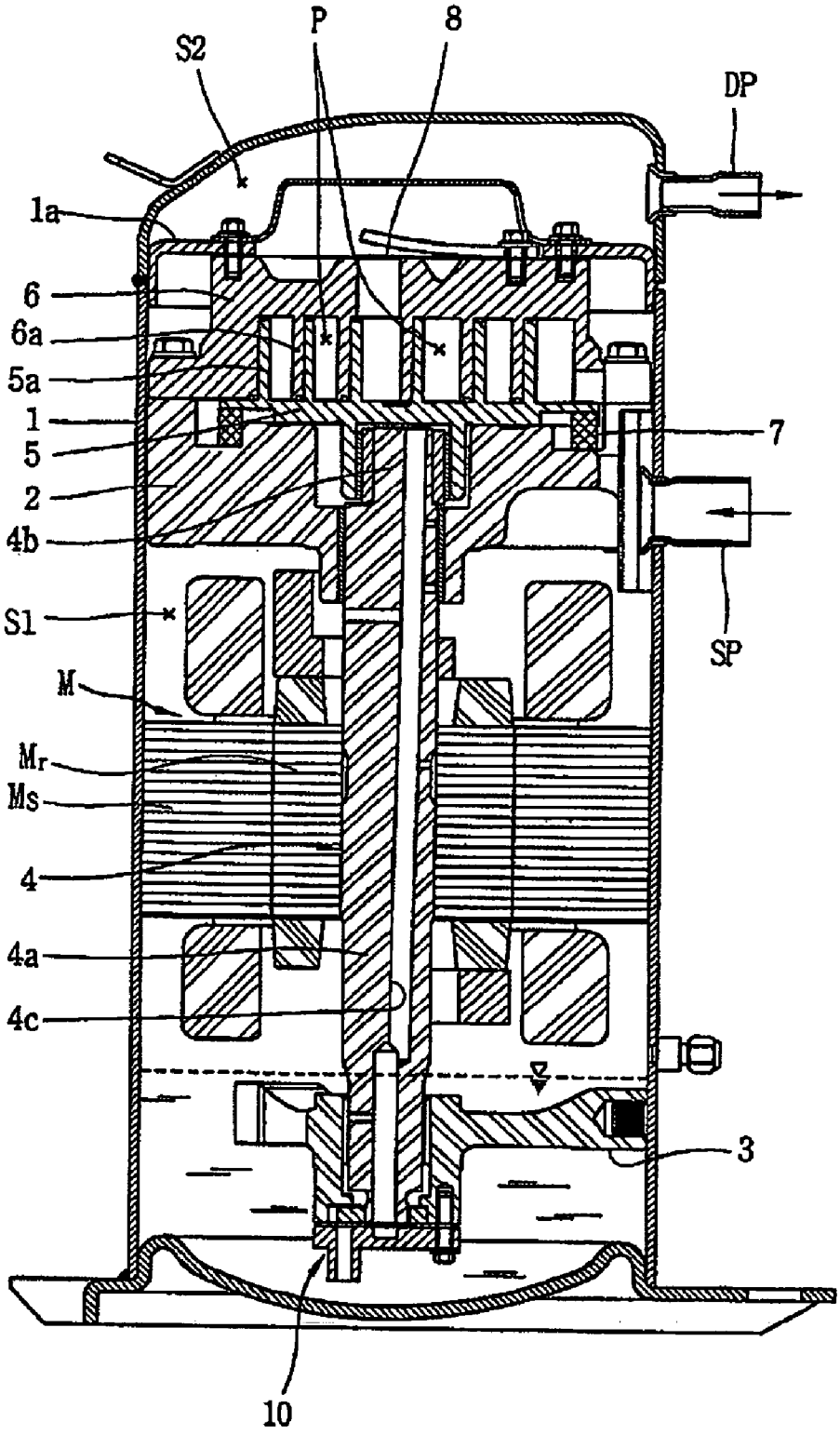
FIG. 2 is a cross sectional view illustrating a scroll compressor using a trochoid pump according to the present invention.
Figure 3:
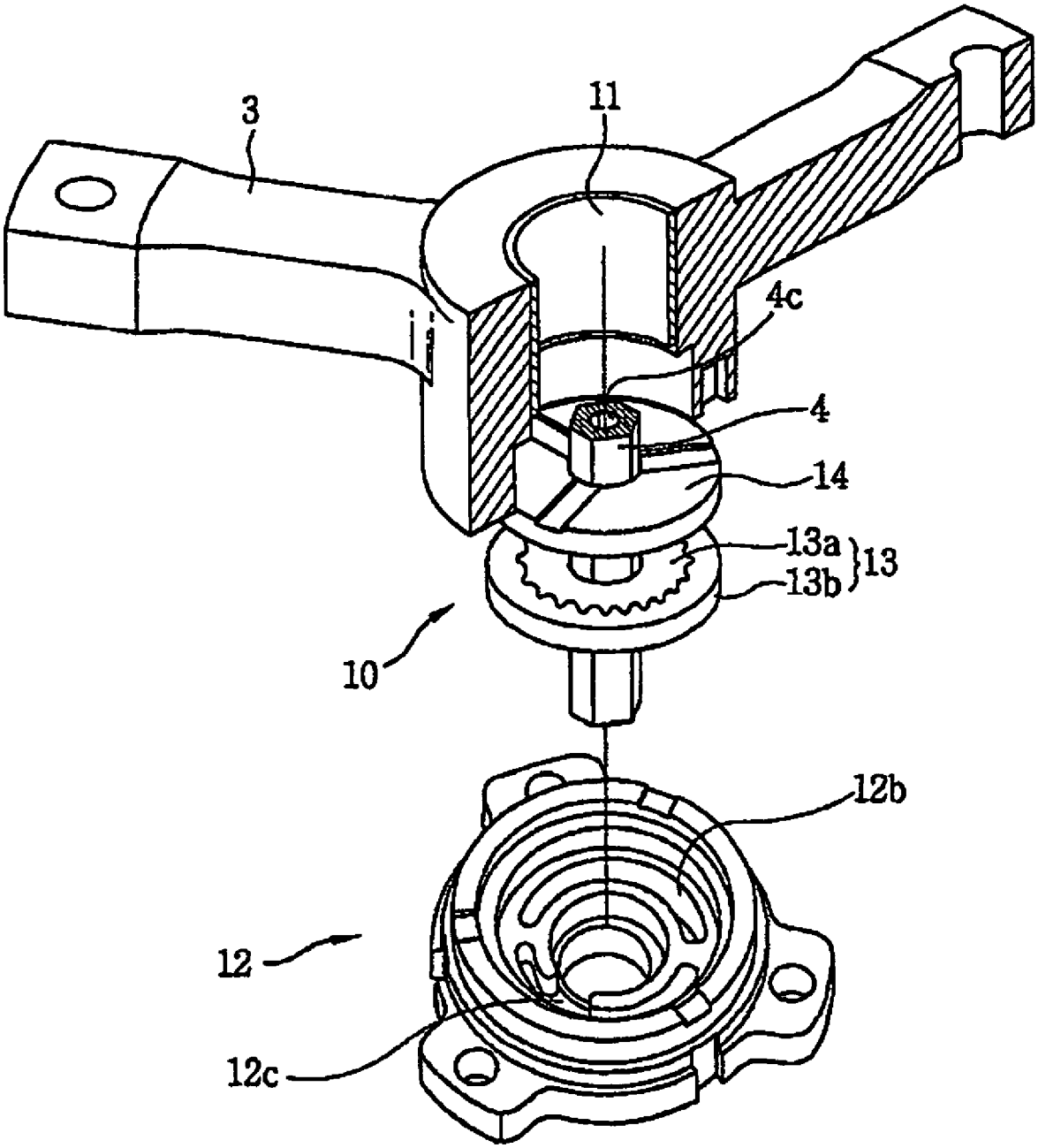
FIG. 3 is an exploded perspective view illustrating the trochoid pump according to a first embodiment of the present invention.

Reference will now be made in detail to an oil pumping device of a scroll compressor according to one embodiment of the present invention, examples of which are illustrated in the accompanying drawings. FIG. 2 is a longitudinal cross-sectional view illustrating a scroll compressor using a trochoid oil pump according to a first embodiment of the present invention. FIG. 3 is an exploded perspective view illustrating the trochoid pump according to the first embodiment of the present invention.

As shown therein, a scroll compressor according to the first embodiment of the present invention includes a casing 1 filled with a predetermined amount of oil. A main frame 2 and a sub-frame 3 are fixed to upper and lower sides, respectively, inside the casing 1. A driving shaft 4 coupled with a rotor of a driving motor (M) is mounted between the main frame 2 and the sub-frame 3 so as to transmit a rotary force. An orbiting scroll 5 is mounted on the main frame 2, coupled with the driving shaft 4, and performs an orbiting motion. A fixed scroll 6 having a spiral wrap 6*a*, is engaged with a wrap 5*a* of the orbiting scroll 5 so as to form a plurality of compression chambers (P). The fixed scroll 6 is fixed to an upper surface of the main frame 2. An Oldham's ring 7 is installed between the orbiting scroll 5 and the main frame 2 so as to prevent rotation of the orbiting scroll 5 and allow the orbiting scroll to perform an orbiting motion. A check valve 8 is coupled to a rear surface of an end plate portion of the fixed scroll 6 so as to prevent backflow of compression gas, which is discharged into a discharge area S2 to be described below. A trochoid oil pump 10 is installed under the driving shaft 4 and pumps the oil within the casing 1 by a change in volume that occurs during rotation of the driving shaft 4.

An internal space of the casing 1 is divided into a suction area (S1) which is a low pressure part, and a discharge area (S2) which is a high pressure part by a high and low pressure separation plate 1*a* that is fixed to an upper surface of the fixed scroll 6. A gas suction pipe (SP) is connected to the suction area (S1), while a gas discharge pipe (DP) is connected to the discharge area (S2).

The driving shaft 4 includes a shaft portion 4*a*, and a driving pin portion 4*b* which eccentrically protrudes from an upper end of the shaft portion 4*a* and which is coupled to the orbiting scroll 5. An oil path 4*c* penetrates the driving shaft 4 from a lower end of the shaft portion 4*a* to an upper end of the driving pin portion 4*b* so as to guide oil which is pumped by the oil pump 10.

Figure 4:
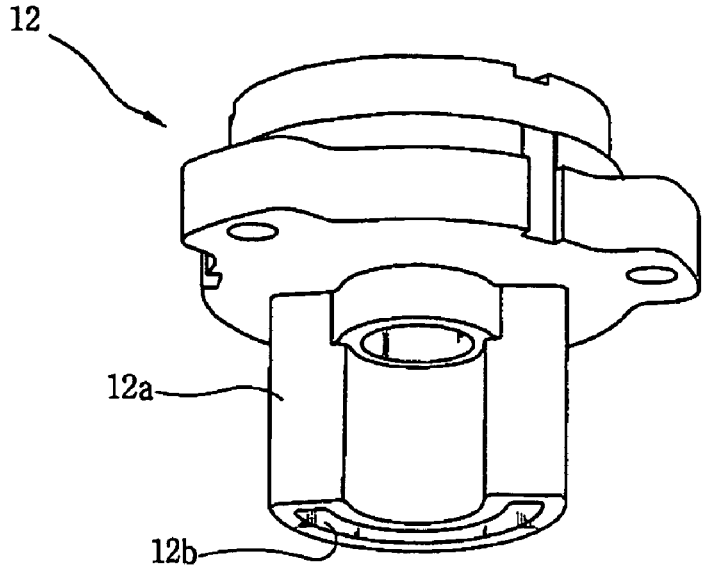
FIG. 4 is a perspective view illustrating a lower part of a pump cover for explaining a suction path of oil of the trochoid pump according to the first embodiment of the present invention.

As shown in FIG. 3, the oil pump 10 includes a pump housing 11 formed at the sub-frame 3. A pump cover 12 is fixed to a lower surface of the pump housing 11, with a predetermined pumping space provided therebetween. As shown in FIG. 4, a suction projection 12*a* with a circular arc shape protrudes downward from one side of a lower surface of the pump cover 12. A trochoid gear 13, and a bearing plate 14 are interposed between the housing and the cover 12. The bearing plate 14 is slidably supported between an upper surface of the trochoid gear 13 and the driving shaft 4 in a shaft direction. The trochoid gear 13 has an outer gear 13*b*, which encompasses the inner gear 13*a* that is coupled with the driving shaft 4. The inner gear 13*a* and the outer gear 13*b* are engaged with each other so as to form a volume while performing a relative rotary motion inside the casing 1. The trochoid gear 13 pumps the oil inside the casing 1 by varying the volume.

As shown in FIGS. 3 and 4, the pump cover 12 has the suction projection 12*a*, which protrudes downward. The suction projection 12*a* has at least one suction hole 12*b* (one suction hole shown) having a circular arc formed through the suction projection 12*a* in the shaft direction at the lower end thereof. The suction projection 12*a* is connected to the pump space. Further, a discharge groove 12*c* is formed on an upper surface of the pump cover 12 so as to connect the suction hole 12*b* to the oil path 4*c* of the driving shaft 4 through the trochoid gear 13.

When power is applied to the driving motor (M), the driving shaft 4 rotates by the applied power and transmits a driving force to the orbiting scroll 5, such that the orbiting scroll 5 orbits. A pair of compression chambers (P), that is, two compression chambers (P), which continuously move, are formed between the wrap 5*a* of the orbiting scroll 5 and the wrap 6*a* of the fixed scroll 6. While the compression chambers (P) move toward the center by the continuous orbiting movement of the orbiting scroll 5, a volume thereof is reduced to thereby compress refrigerant gas.

Figure 5:
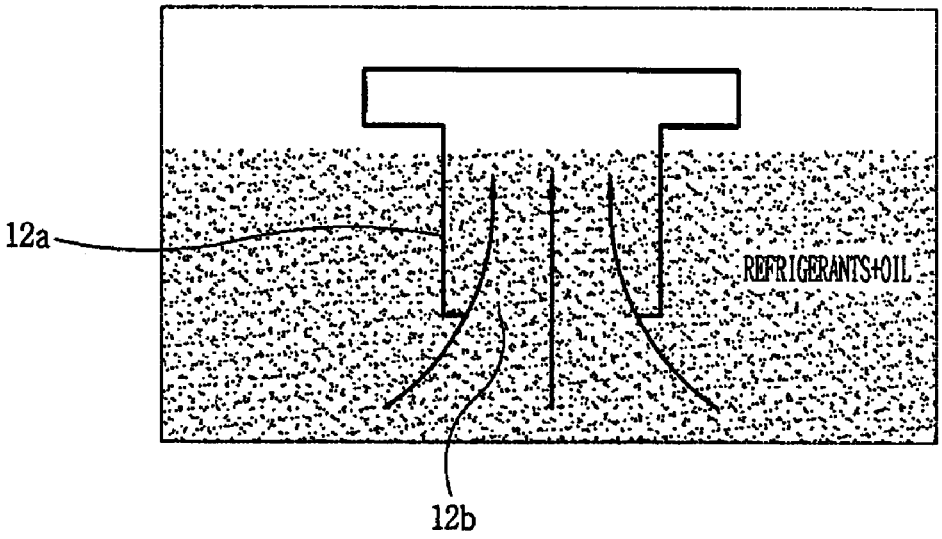
FIG. 5 is a schematic view illustrating an oil supplying process according to the first embodiment of the present invention.

At the same time, the trochoid oil pump 10 provided under the driving shaft 4 operates so as to pump the oil filled in the lower part of the casing 1. For example, as shown in FIG. 5, the inner gear 13*a*, which is coupled with the driving shaft 4, and the outer gear 13*b* of the trochoid oil pump 10 are engaged with each other and rotate relative to each other, thereby varying the volume thereof. Further, the oil in the casing 1 is sucked into the pumping space of the pump cover 12 through the suction hole 12*b* of the suction projection 12*a*, which is located under the surface of the oil. The sucked oil is pumped up along the oil path 4*c* of the driving shaft 4 through the discharge groove 12*c*.

The trochoid oil pump induces a change in volume of the trochoid gear so as to suck up the oil. Since a predetermined amount of oil is constantly pumped for each revolution of the gear, even during low-speed operations, abrasion of the sliding parts that is caused by lack of oil during low speed operations is prevented. This, in turn, thereby increases reliability and performance of the compressor. In addition, because the suction hole 12*b* has a circular arc, oil can constantly be sucked along a trace of the trochoid gear, to thereby increase an amount of oil pumped.

Figure 6:
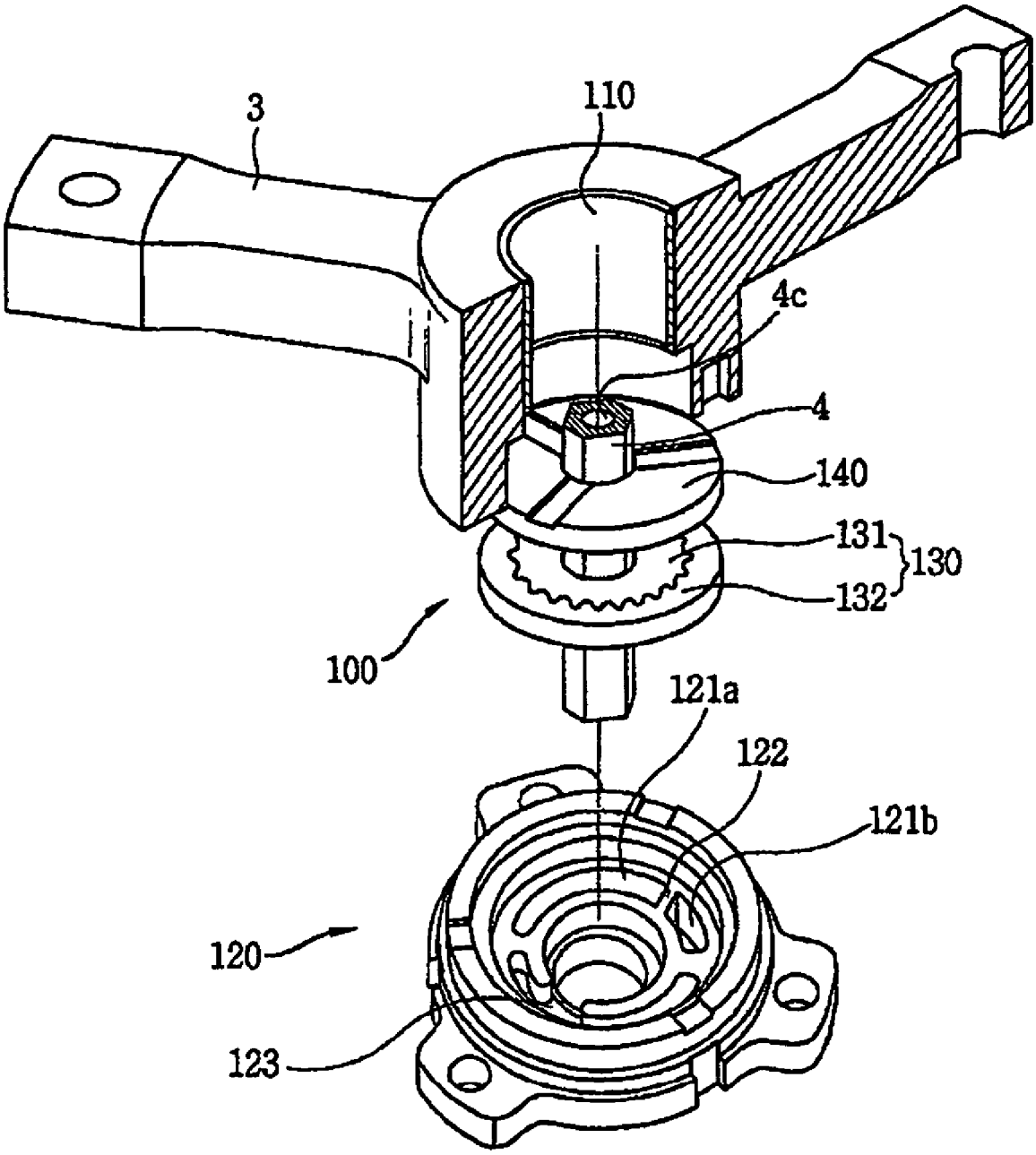
FIG. 6 is an exploded perspective view illustrating a trochoid pump according to a second embodiment of the present invention.
Figure 7:
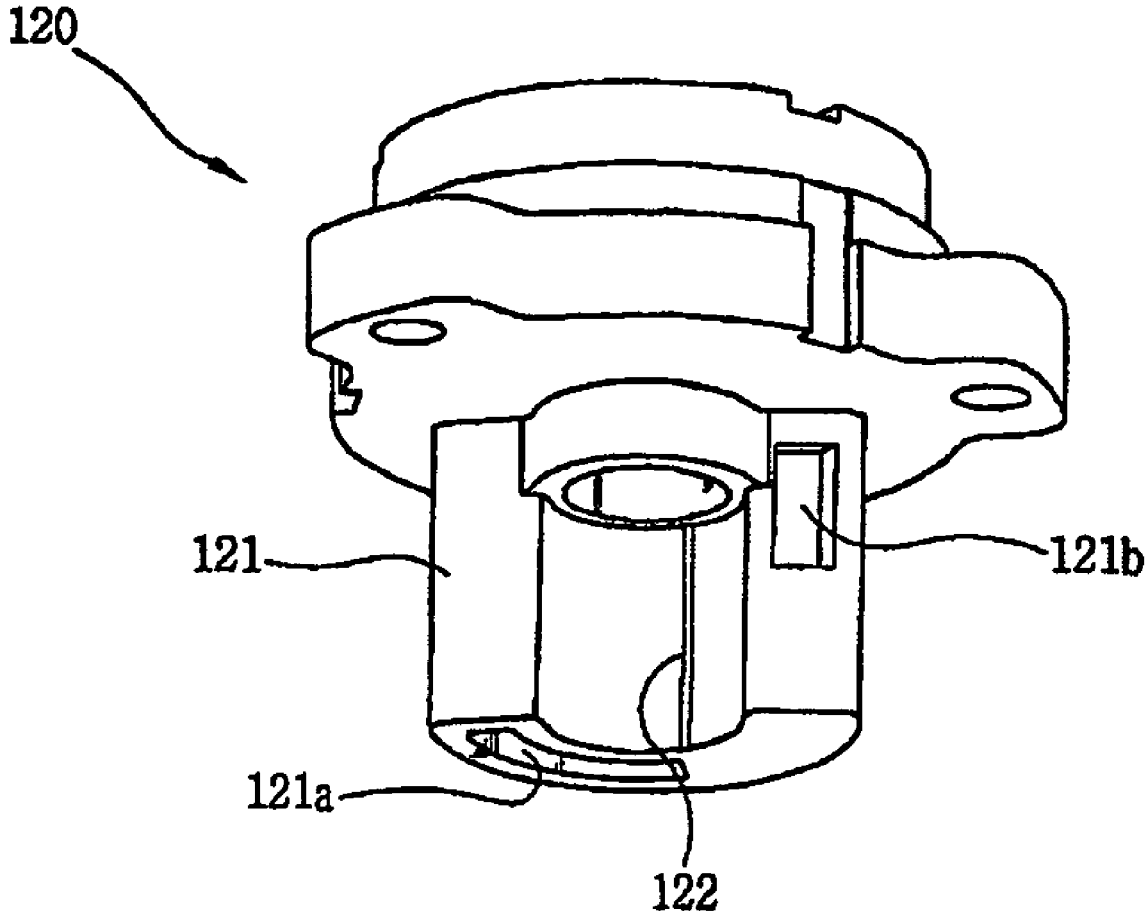
FIG. 7 is a perspective view illustrating a lower part of a pump cover for explaining a suction path of oil of the trochoid pump according to the second embodiment of the present invention.

Another embodiment of a trochoid pump of a scroll compressor according to the present invention will be described with reference to FIGS. 6 and 7. FIG. 6 is an exploded perspective view illustrating a trochoid pump according to a second embodiment of the present invention. FIG. 7 illustrates a pump cover 120 of the second embodiment.

As shown therein, the oil pump 100 includes a pump housing 110 formed at the sub-frame 3. A pump cover 120 is fixed to a lower surface of the pump housing 110 with a predetermined pumping space provided therebetween. A plurality of suction projections 121*a* and 121*b* are formed at one side of a lower surface of the pump cover 120. A trochoid gear 130, and a bearing plate 140 are interposed between the housing 110 and the cover 120. The bearing plate 140 is sidably supported between an upper surface of the trochoid gear 130 and the driving shaft 4 in a shaft direction.

The trochoid gear 130 has an outer gear 132 and an inner gear 131, which is loaded on an upper surface of the pump cover 120 and which is coupled with the driving shaft 4. The inner gear 131 and the outer gear 132 are engaged with each other so as to form a volume while performing a relative rotary motion inside the casing 1. The trochoid gear 130 pumps the oil inside the casing 1 by varying the volume.

As shown in FIGS. 6 and 7, the pump cover 120 has a suction projection 121, which protrudes downward. Inside the suction projection 121 is a first suction hole 121*a* having a circular are penetrating through the suction projection 121 in the shaft direction. The suction projection 121 is connected to the pumping space at the lower end thereof. Also, a second suction hole 121*b* having a circular arc penetrates through the suction projection 121 in the shaft direction at a side surface thereof. A partition 122 is formed between the first suction hole 121*a* and the second suction hole 121*b*. Both suction holes 121*a* and 121*b*, which are separated from each other by the partition 122, are connected to the volume of the trochoid gear 130 along the trace of the trochoid gear 130.

The first suction hole 121*a* and the second suction hole 121*b* may have the same cross section or different cross sections from each other. To more consistently supply oil, the second suction hole 121*b* may have a larger cross section than the first suction hole 121*a*.

In addition, a discharge groove 123 is formed on the upper surface of the pump cover 120 so as to connect the first suction hole 121*a* and the second suction hole 121*b* to the oil path 4*c* of the driving shaft 4 through the trochoid gear 130.

In either embodiment, the driving shaft 4 rotates by power applied to the driving motor (M), and the orbiting scroll 5 orbits. A pair of compression chambers (P), that is, two compression chambers (P), which continuously move, are formed between the wrap 5*a* of the orbiting scroll 5 and the wrap 6*a* of the fixed scroll 6. The compression chambers (P) move toward the center by the continuous orbiting movement of the orbiting scroll 5, and thus a volume thereof is reduced to thereby compress refrigerant gas. At the same time, when the trochoid oil pump 100 provided under the driving shaft 4 sinks under the oil and rotates, the oil filled in the lower part of the casing 1 is sucked up along the oil path 4*c* of the driving shaft 4 so as to lubricate the respective sliding parts.

Figure 8:
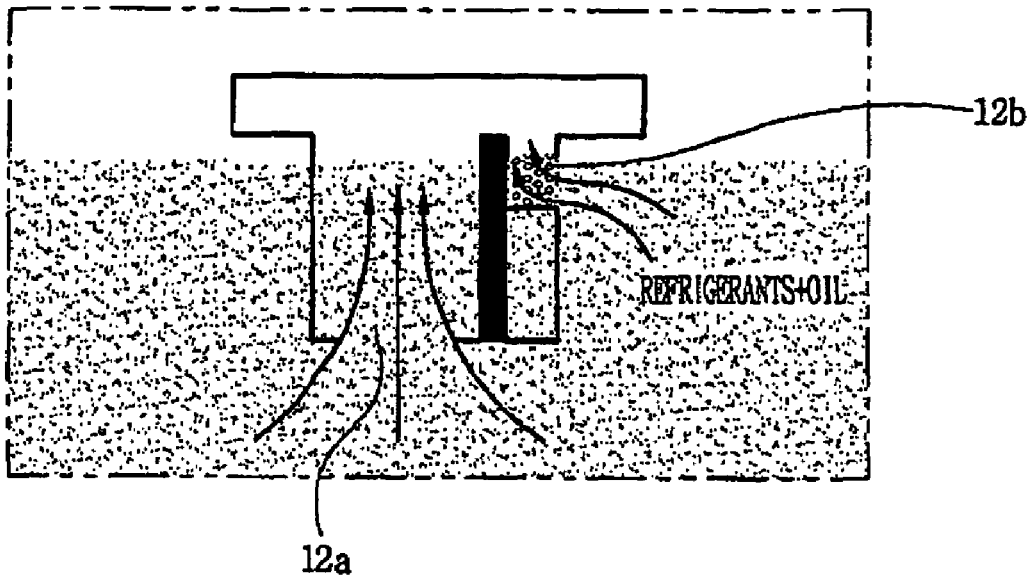
FIG. 8 is a schematic view illustrating an oil supplying process in a state where refrigerant and oil are mixed with each other in the trochoid pump according to the second embodiment of the present invention.

The oil to be filled in the casing 1 has a mixed degree of oil and refrigerant that varies according to oil types, refrigerant types, or external conditions. In the second embodiment, the amount of oil pumped can vary according to positions of the suction holes 121*a* and 121*b* of the oil pump 100. For example, as shown in FIG. 8, when the oil and the refrigerant are completely mixed with each other, regardless of whether the suction holes of the pump cover 120 are formed at only the lower end of the suction projection 121 or both the first suction hole 121*a* at the bottom surface and the second suction hole 121*b* at the side surface, the refrigerant and the oil are sucked together to thereby smoothly lubricate the sliding parts of the compressor.

Figure 9:
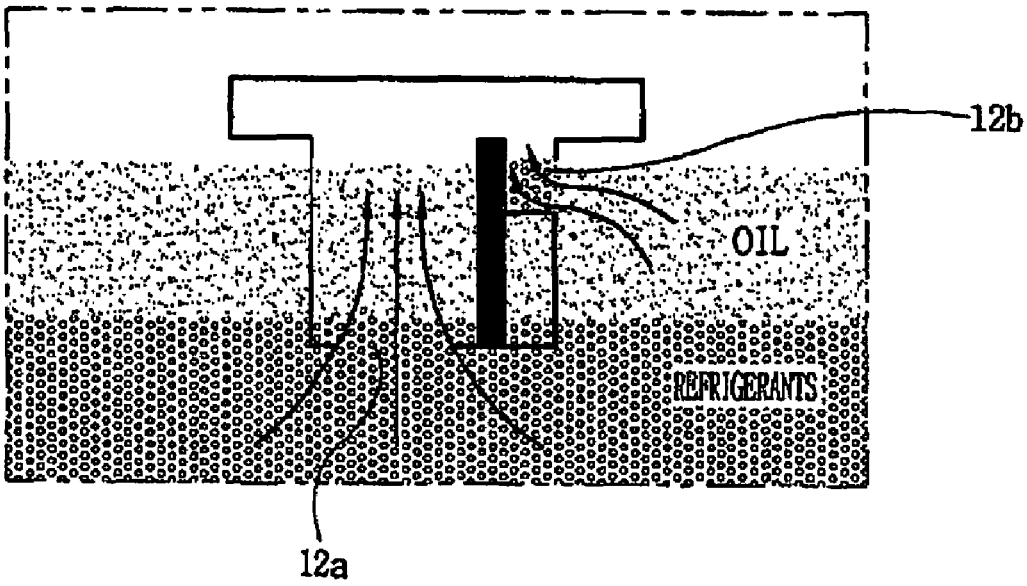
FIGS. 9 to 11 are schematic views illustrating an oil supplying process in a state where refrigerant and oil are separate from each other in a trochoid pump according to another embodiment of the present invention.

On the other hand, as shown in FIG. 9, when a 'double-layer separation phenomenon' occurs, that is, the refrigerant and the oil are not completely mixed with each other, the refrigerant having a relatively high density is deposited at the lower part. In this instance, if there were only a suction hole positioned on the bottom of the pump cover, the suction hole would suck primarily only the refrigerant and it would be difficult to smoothly pump oil. In the second embodiment, however, the refrigerant is sucked through the first suction hole 121*a* and oil is sucked through the second suction hole 121*b*, such that oil is smoothly supplied to the compressor parts.

Figure 10:
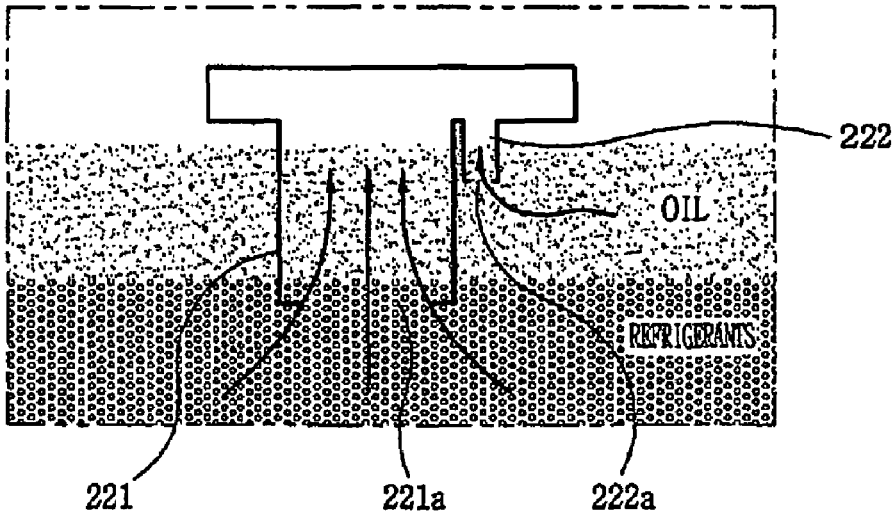

In the above-described second embodiment, one suction projection 121 is formed on the pump cover 120, and the first suction hole 121*a* and the second suction hole 121*b* are formed at the lower and side surfaces of the suction projection 121, respectively. In a third embodiment, as shown in FIG. 10, a plurality of suction projections are provided on the pump cover. That is, a first suction projection 221 and a second suction projection 222, are formed on the pump cover 220. A first suction hole 221*a* is formed at the bottom of the first suction projection 221, and a second suction hole 222*a* is formed at the bottom of the second suction projection 222. The two suction holes are separated by a predetermined height difference.

In this third embodiment, when the oil and the refrigerant are almost completely mixed with each other, the mixed refrigerant and the oil are sucked together through both suction holes 221*a* and 222*a*. On the other hand, when the oil and the refrigerant are separated from each other as a double layer, refrigerant is sucked through the suction hole 221*a* of the first suction projection 221, which is relatively deeply extended, while oil is sucked through the suction hole 222*a* of the second suction projection 222, which is relatively shallowly extended. Therefore, regardless of the degree of mixing of the oil and refrigerant, oil can always be pumped, thereby increasing reliability of the compressor.

Figure 11:
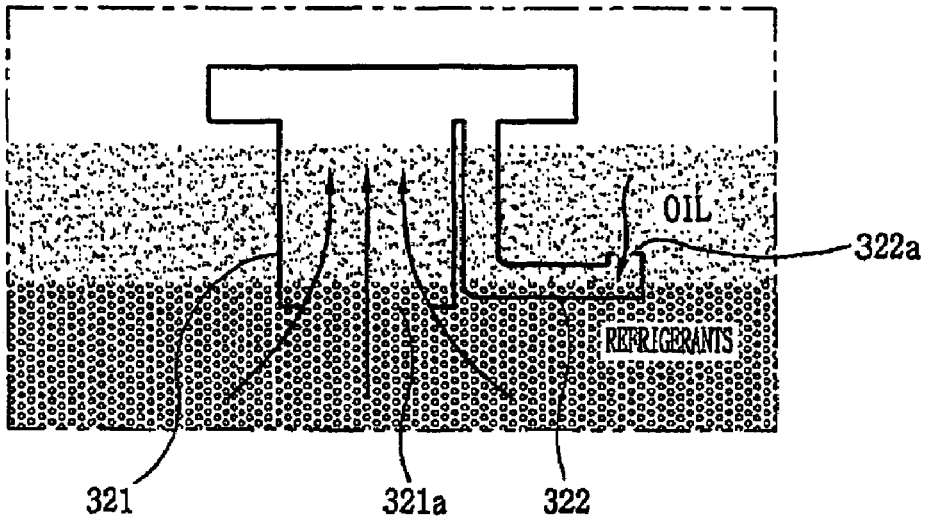

When a separate second suction projection is used, the second suction projection may have various shapes. The shape can be used to help control the amount of oil that is pumped. For example, as shown in FIG. 11, a first suction projection 321 is deeply extended and has a first suction hole 321*a* at a lower end thereof. A second suction projection 322 extends downward and is bent outward in a radial direction.

The second suction projection is then bent again in an upward direction to thereby form a second suction hole 322*a*. The second suction projection 322 sucks oil from a point above a boundary of the refrigerant and the oil, such that the amount of oil pumped can be increased.

Embodiments of the invention could also include more than two projections that extend downward on the cover. For instance, there might be three or more projections that all extend downward to varying depths. There would be a corresponding number of suction holes on each downwardly extending protrusion.

In addition, in some embodiments, multiple suction holes could be formed on each downwardly extending protrusion. Thus, there might be two downwardly extending protrusions, and there might be two or more suction holes formed on each protrusion. The multiple suction holes on each downwardly extending protrusion might all be formed at the same relative depth, or the suction holes could all be formed at varying depths.

The present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A hermetic compressor, comprising:

a casing filled with a predetermined amount of oil;

a motor mounted in the casing that generates a driving force;

a compressor that is coupled with a driving shaft of the motor and that compresses refrigerant; and an oil pumping unit, comprising:

a trochoid gear that is coupled with the driving shaft of the motor;

a pump housing into which the driving shaft is inserted; and a pump cover fixed to the pump housing and having at least one suction hole, wherein the trochoid gear is mounted between the pump housing and the pump cover, and wherein the pump cover has a suction projection that projects away from the pump housing, and wherein the at least one suction hole extends through the pump cover from a lower surface of the suction projection to an upper portion of the pump cover so as to be connected to a volume of the trochoid ear.

2. The hermetic compressor of claim 1, wherein the oil pumping unit pumps oil while an inner gear and an outer gear thereof rotate relative to each other to vary a volume thereof.

3. The hermetic compressor of claim 2, wherein the pump housing is integral with a frame that supports the driving shaft.

4. The hermetic compressor of claim 1, wherein a cross-section of the suction hole forms a circular arc.

5. The hermetic compressor of claim 1, wherein the at least one suction hole comprises two suction holes that are located at different relative depths on the pump cover.

6. A hermetic compressor, comprising:

a casing filled with a predetermined amount of oil;

a motor mounted in the casing that generates a driving force;

a compressor that is coupled with a driving shaft of the motor and that compresses refrigerant; and an oil pumping unit, comprising:

a pump housing into which the driving shaft is inserted;

a pump cover fixed to the pump housing, wherein the plurality of suction holes are formed on the pump cover; and a trochoid gear mounted between the pump housing and the pump cover, coupled with the driving shaft, and pumping oil while an inner gear and an outer gear thereof rotate relative to each other, wherein the pump cover comprises a suction projection at a lower surface thereof, and wherein a plurality of suction holes extend through the suction projection and are connected to a volume of the trochoid gear, and wherein a first suction hole is located at a greater depth in the casing than a second suction hole.

7. The hermetic compressor of claim 6 wherein the pumping housing is integral with a frame that supports the driving shaft.

8. The hermetic compressor of claim 6, wherein a partition is formed in the suction projection such that the plurality of suction holes form flow paths independent from each other.

9. The hermetic compressor of claim 6, wherein the first suction hole has a opening formed at a lower surface of the suction projection, and wherein the second suction hole has an opening formed on side surface of the suction projection.

10. The hermetic compressor of claim 9, wherein a partition is formed in the suction projection such that the plurality of suction holes form flow paths independent from each other, wherein the first suction hole is located on a first side of the partition, and wherein the second suction hole is located on the second side of the partition.

11. The hermetic compressor of claim 6, wherein the pump cover comprises a plurality of suction projections which protrude downward away from the housing, and wherein at least one suction hole is formed in each suction projection and wherein each of the suction holes is connected to a volume of the trochoid gear.

12. The hermetic compressor of claim 11, wherein an opening of the first suction hole is formed in a first suction projection, and wherein an opening of the second hole is formed in a second suction projection.

13. The hermetic compressor of claim 12, wherein the first suction projection extends to a greater depth in the casing than the second suction projection.

14. The hermetic compressor of claim 11, wherein an opening of a suction hole is formed at a lower surface of each of the suction projections.

15. The hermetic compressor of claim 11, wherein a first suction projection extends straight downward away from the housing, and where a second suction projection comprises a first section that extends downwards away from the housing and a second section that extends radially towards a side of the housing.

16. The hermetic compressor of claim 15, wherein the second projection further includes a third section that extends from an end of the second section upward towards an upper portion of the casing.

17. The hermetic compressor of claim 6, wherein among the plurality of suction holes, suction holes having openings positioned higher up in the casing have wider cross sections than suction holes having openings positioned lower in the casing.

18. An oil pump unit for use in a hermetic compressor, comprising:

a pump housing that is configured to be connected to a casing of a hermetic compressor;

a cover coupled to the pump housing; and a trochoid pump mechanism mounted between the pump housing and the cover and configured to be coupled to a rotating shaft of the hermetic compressor, wherein at least two suction holes are formed on the cover, and wherein an opening of a first suction hole is located further from the trochoid pump mechanism than an opening of a second suction hole, wherein the cover comprises a suction projection that extends away from the trochoid pump mechanism, and wherein the opening of the first suction hole is formed on a first surface of the suction projection that is furthest from the of the trochoid pump mechanism, and wherein the opening of the second suction hole is located on a second surface of the suction projection that is closer to the trochoid pump mechanism than the first surface.

19. The oil pump of claim 18, wherein a partition is formed in the cover between the first and second suction holes.

20. The oil pump of claim 18, wherein the cover comprises at least two suction projections, wherein the opening of the first suction hole is located on a first suction projection, and wherein the opening of the second suction hole is located on a second suction projection.

21. The oil pump of claim 20, wherein the first suction projection extends further away from the trochoid pump mechanism than the second suction projection.

22. The oil pump of claim 18, wherein the opening of the first suction hole is oriented in a first direction, and wherein the opening of the second suction hole is oriented in a second direction that is different from the first direction.

23. The oil pump of claim 22, wherein the first direction is oriented perpendicular to the second direction.

24. The oil pump of claim 22, wherein the first direction is oriented opposite the second direction.

* * * * *